US011166527B2

(12) United States Patent
Tolk et al.

(10) Patent No.: US 11,166,527 B2
(45) Date of Patent: Nov. 9, 2021

(54) DETACHABLE BELT CONNECTOR SYSTEM

(71) Applicant: Dräger Safety AG & Co. KGaA, Lübeck (DE)

(72) Inventors: Siegbert Tolk, Lübeck (DE); Lennart Wenzel, Lübeck (DE); Tim Blöcker, Lübeck (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 0 days.

(21) Appl. No.: 17/096,344

(22) Filed: Nov. 12, 2020

(65) Prior Publication Data

US 2021/0145131 A1 May 20, 2021

(30) Foreign Application Priority Data

Nov. 20, 2019 (DE) ..... 10 2019 008 045.9

(51) Int. Cl.
*A44B 11/26* (2006.01)
*A44B 11/25* (2006.01)
*A42B 3/08* (2006.01)

(52) U.S. Cl.
CPC ..... *A44B 11/266* (2013.01); *A44B 11/2553* (2013.01); *A42B 3/08* (2013.01)

(58) Field of Classification Search
CPC . Y10T 24/47; Y10T 24/4736; Y10T 24/4745; Y10T 24/4764; A44B 11/266; A44B 11/2553; A42B 3/08
See application file for complete search history.

(56) References Cited

U.S. PATENT DOCUMENTS 2,846,683 A 8/1958 Dye et al.
3,430,306 A * 3/1969 Henri ..... H01R 13/20 24/593.1
5,027,481 A * 7/1991 Frano ..... A44B 11/266 24/606
7,464,448 B2 * 12/2008 Kolasa ..... A44B 11/266 24/616
9,526,301 B1 * 12/2016 Sloan ..... A44B 11/006
(Continued)

FOREIGN PATENT DOCUMENTS

DE 20014596 U1 1/2002
DE 202011107018 U1 1/2012
(Continued)

*Primary Examiner* — Robert Sandy
(74) *Attorney, Agent, or Firm* — McGlew and Tuttle, P.C.

(57) ABSTRACT

A detachable belt connector system (100), for the detachable connection of belt ends (770, 775), includes a first connector element (110) with a first connection area (112) and a first belt fastening area (116) and a second connector element (120) with a second connection area (122) and a second belt fastening area (126). The first and second connection areas are configured to be connected to one another in a detachably with a positive-lock. The belt ends can be fastened at the belt fastening areas via a corresponding permanent fastening mechanism. The first belt fastening area and/or the second belt fastening area are configured such that they have a predetermined breaking region (140), by means of which an irreversible break takes place at the belt fastening area having the predetermined breaking region when a predefined limit pulling force (150) is applied at the detachable belt connector system.

20 Claims, 6 Drawing Sheets

(56) References Cited

U.S. PATENT DOCUMENTS

| | | | | |
|---|---|---|---|---|
| 2011/0061211 | A1* | 3/2011 | Anscher | A44B 11/266<br>24/190 |
| 2020/0178652 | A1* | 6/2020 | Ma | A44B 11/266 |

FOREIGN PATENT DOCUMENTS

| | | | |
|---|---|---|---|
| EP | 3165108 | A1 | 5/2017 |
| GB | 2382375 | A | 5/2003 |
| GB | 2531146 | A | 4/2016 |
| WO | 2018024493 | A1 | 2/2018 |

* cited by examiner

DETACHABLE BELT CONNECTOR SYSTEM

CROSS REFERENCE TO RELATED APPLICATIONS

This application claims the benefit of priority under 35 U.S.C. § 119 of German Application 10 2019 008 045.9, filed Nov. 20, 2019, the entire contents of which are incorporated herein by reference.

TECHNICAL FIELD

The present invention pertains to a detachable belt or strap connector system, to a chin strap lock with two belt ends and with a detachable belt connector system and to a safety helmet with a chin strap lock.

TECHNICAL BACKGROUND

Detachable belt connector systems in different variants and for different applications are known. It is, in principle, the object of a detachable connector system to connect two belt ends to one another in a reliable manner until this connection is severed again due to manual manipulation of the closed belt connector system.

For special applications, for example, the use of a detachable belt connector system on a firefighter helmet, the requirement is, furthermore, known that the detachable belt connector system is opened in the case of a predefined limit pulling force for protection against a strangulation of the user of the firefighter helmet.

For accomplishing such a protection against strangulation, the use of a break ring, which breaks at the predefined limit pulling force and as a result releases two belt ends, is currently common.

SUMMARY

An object of the present invention is to provide an improved detachable belt or strap connector system, especially a detachable belt connector system that can be manufactured in an especially simple manner.

A detachable belt connector system, especially a chin strap lock for the detachable connection of a first belt end and of a second belt end with a first connector element and with a second connector element, is proposed according to the present invention to accomplish this object.

The first connector element has a first connection area and a first belt fastening area.

The second connector element has a second connection area and a second belt fastening area.

The first connection area and the second connection area are in this case configured such that the first connector element and the second connector element can be connected to one another via the two connection areas in a detachable and positive-locking manner, and wherein the first belt end can be fastened at the first belt fastening area and the second belt end can be fastened at the second belt fastening area via a corresponding permanent fastening mechanism. In this connection, the first belt fastening area and/or the second belt fastening area are configured such that they have a predetermined breaking point (also referred to herein as a predetermined breaking region), by means of which an irreversible break, especially an irreversible break for opening the permanent fastening mechanism, takes place at the belt fastening area having the predetermined breaking point/region when a predefined limit pulling force is applied at the detachable belt connector system.

It was found within the framework of the present invention that for protection against strangulation in the presence of a predefined limit pulling force, a mechanism which can be manufactured in an especially simple manner by providing a predetermined breaking point at one of the two connector elements can be made possible. Furthermore, it was found that such a simple structure of the two connector elements leads in an especially reliable manner to a release of the two belt ends when the predefined limit pulling force is present.

Because the predetermined breaking point/region is provided in at least one of the two belt fastening areas of a connector element of the belt connector system according to the present invention, both manual connecting of the belt ends and release of the belt ends in the case of a predefined limit pulling force can be achieved by the two connector elements being coordinated with one another. In particular, a separate part, for example, a break ring, is thereby avoided. This advantageously reduces the cost and complexity in case of the manufacture of the belt connector system.

Furthermore, the simple structure of the detachable belt connector system according to the present invention makes possible a one-piece manufacture of the first connector element and of the second connector element.

The release of the two belt ends takes place here in an especially reliable manner, since a force, for example, a force acting on a helmet connected to the belt connector system, also acts in a reliable manner on the two connector elements of the belt connector system.

The permanent fastening mechanism of the respective belt end at the respective belt fastening area is embodied, for example, by a stitching. Furthermore, the permanent fastening mechanism may be a bonding, welding or the like. At least one of the two permanent fastening mechanisms preferably makes it possible to adjust the belt end, for example, in order to set the length of a belt via this belt end. For example, a corresponding binding of the belt end may also form a permanent fastening mechanism. The fastening mechanism is permanent according to the present invention because it is not detached by itself even at high pulling forces and even after several typical use times of the belt connector system. The permanent fastening mechanism may, however, be detached manually in some embodiments of the belt connector system according to the present invention.

The irreversible break at the predetermined breaking point/region can lead to a breaking out of a part of the corresponding belt fastening area or to a breaking open of a part of the corresponding belt fastening area.

The positive-locking connection of the two connector elements can be achieved according to the present invention by one of the many already known structures of connector elements, for example, by a plug-type connection (also referred to herein as a plug connection).

The predefined limit pulling force is preferably a pulling force applied between the two belt ends.

Preferred embodiments of the belt connector system according to the present invention will now be described below.

In an especially preferred embodiment, when in a state of being connected to one another the two connection areas are configured such that they are not detached from one another when a predefined limit pulling force is applied. It is ensured in this exemplary embodiment that the detachable belt connector system withstands pulling forces up to the predefined limit pulling force. As a result, a reliable connection between the two connector elements is ensured.

In another advantageous embodiment, the first connector element and the second connector element have a one-piece configuration each. In this embodiment, the two connector elements can be manufactured in an especially simple and cost-effective manner. In a variant of this embodiment, the first connector element and the second connector element are manufactured by an injection molding process or by a 3D printing process. An especially fast and cost-effective manufacture is possible in this variant.

In an especially preferred embodiment, the predetermined breaking point/region is formed in a break ring, in an eyelet, in a hook, in a structural tapered area and/or in a bending beam of the corresponding belt fastening area. The structure of the predetermined breaking point/region, in particular its material thickness, ensures that it leads to the irreversible break when the predefined limit pulling force is applied. The precise static configuration of such a structure with specification of the predefined limit pulling force is known from many related technical areas and will not be explained in detail below. In an especially simple variant of this embodiment, the predetermined breaking point/region is provided in the break ring, which forms a part of the first and/or second connector element and the structure of the break ring corresponds to that of the break ring known from the state of the art.

In another embodiment, a particular predetermined breaking point/region, which leads to an irreversible break when a predefined limit pulling force is applied, is provided in the first connector element and in the second connector element. The provision of a plurality of predetermined breaking point/regions makes possible a break in an especially reliable manner when the predefined limit pulling force is applied, even if this limit pulling force is applied from an angle, which possibly prevents the break at one of the predetermined breaking point/regions.

An area of lesser material thickness is formed at the predetermined breaking point/region compared to a material thickness that is present at a spaced location from the predetermined breaking point/region in an especially preferred embodiment. As a result, the predetermined breaking point/region can be embodied in an especially cost-effective and reliable manner. Such a change in the material thickness can be analyzed in an especially reliable manner by means of known, existing software solutions, so that the irreversible break takes place in a reliable manner when the predefined limit pulling force is applied.

In another embodiment, the predetermined breaking point/region is formed by a semicircular tapered area, especially a semicircular tapered area of a material enclosing an eyelet of the belt fastening area. In an alternative or additional embodiment, the predetermined breaking point/region is formed by an angular, especially triangular or rectangular tapered area.

In another embodiment, the predetermined breaking point/region is manufactured from a different material than the corresponding connection area of the corresponding connector element. The irreversible break can especially advantageously develop in this embodiment when the predefined limit pulling force is applied by the connection between the two materials used for the connector element being severed, especially broken open precisely at the predefined limit pulling force. As an alternative or in addition, the irreversible break can develop when the predefined limit pulling force is applied in this embodiment by the other material breaking when the predefined limit pulling force is applied. In this alternative or additional embodiment, the predetermined breaking point/region is formed by the area of the other material, which breaks as planned when the predefined limit pulling force is applied.

In a preferred embodiment, the detachable belt connector system is manufactured by an injection molding process. An especially simple and cost-effective manufacture is possible as a result.

In an especially preferred and advantageous embodiment, the two connector elements form a plug-type connection. In this case the first connection area preferably forms a male part of the plug-type connection and the second connection area forms a female part of the plug-type connection. Such a structure of the connector elements advantageously makes possible that already known structures can be used for the two connector elements in order to form the detachable belt connector system according to the present invention in combination with at least one belt fastening area configured according to the present invention with a predetermined breaking point/region. Furthermore, a plug-type connection can ensure in an especially reliable manner a connection between the two connection areas. In a preferred variant of this embodiment, the two connection areas are configured here such that when in a state of being connected to one another they are not detached from one another when the predefined limit pulling force is applied. The guarantee of a reliable connection between the two connection areas can be made possible in an especially simple manner by a positive-locking connection provided by means of the plug-type connection.

According to another aspect of the present invention, a chin strap lock with two belt ends and with a detachable belt connector system according to at least one of the above embodiments is proposed to accomplish the object mentioned above. Preferably, in this case, the first belt end is permanently fastened at the first belt fastening area and the second belt end is permanently fastened at the second belt fastening area. In such a structure, the chin strap lock can be used for the secure fixing of a helmet on a head. The predefined limit pulling force is in this case preferably a pulling force being applied between the two belt ends.

According to an especially advantageous aspect of the present invention, a safety helmet, especially a firefighter helmet, which has a chin strap lock in accordance with one of the above embodiments, is proposed to accomplish the object mentioned above.

A safety helmet, and especially a firefighter helmet, is often used under ambient conditions that are difficult to predict, so that suddenly occurring pulling forces on the safety helmet are also expected. Therefore, the irreversible break occurring according to the present invention when the predefined limit pulling force is applied is especially advantageous to prevent physical damage to the user of the safety helmet when pulling forces occur suddenly.

Furthermore, the safety helmet makes possible a separation of the two belt ends from one another even if a manual opening of the connection between the two connection areas is not possible, for example, because of the absence of manual accessibility or because of plastic deformation of the belt connector system.

The present invention shall now be explained in more detail on the basis of advantageous exemplary embodiments, which are schematically shown in the figures.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
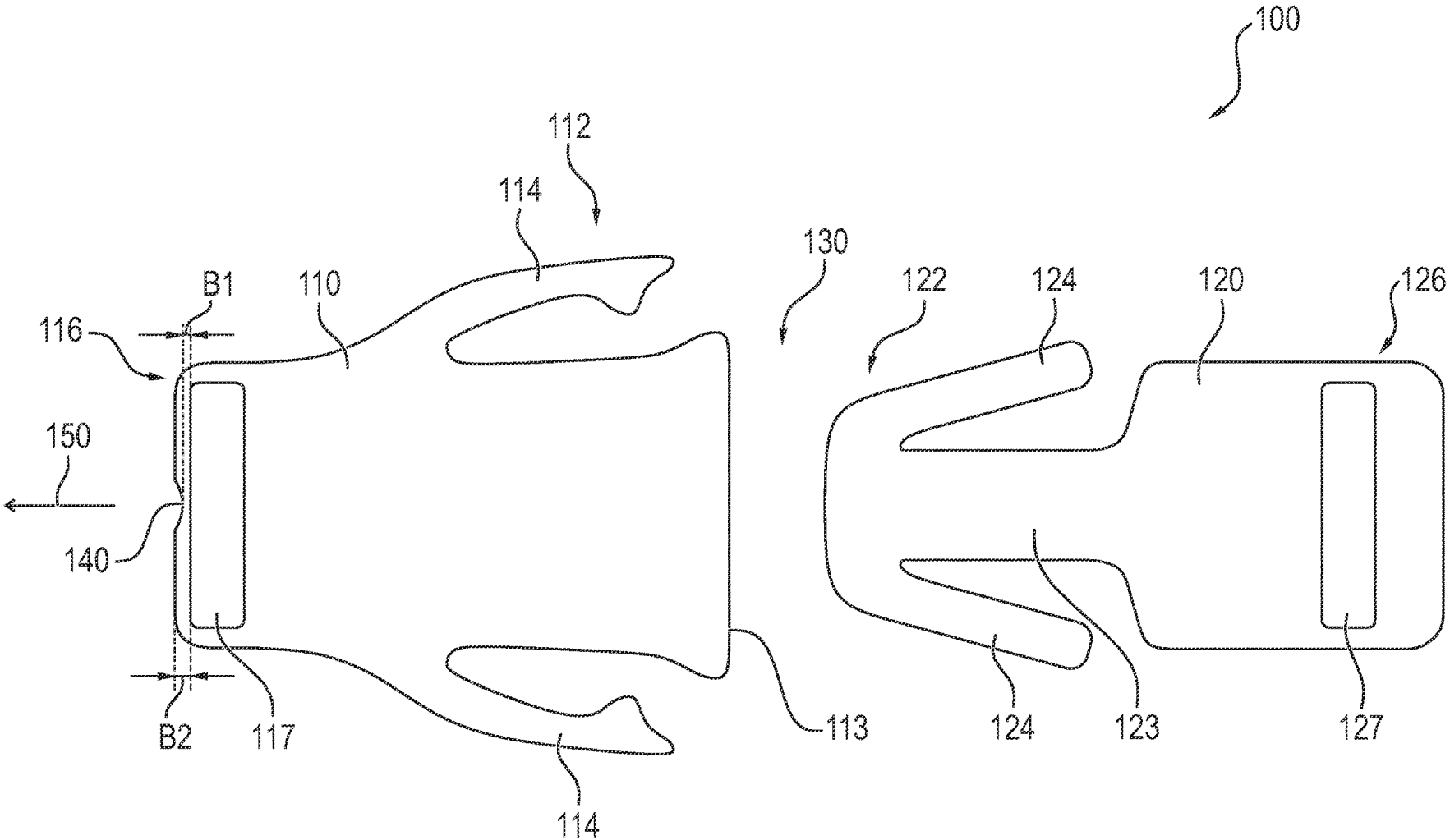
FIG. 1 is a schematic view of a first exemplary embodiment of a detachable belt connector system according to the present invention in an opened state.

Referring to the drawings, FIG. 1 shows a schematic view of a first exemplary embodiment of a detachable belt connector system 100 according to the present invention in an open state.

The detachable belt connector system is configured for the detachable connection of a first belt end and of a second belt end and comprises a first connector element 110 and a second connector element 120 for this purpose.

The first connector element 110 has a first connection area 112 and a first belt fastening area 116. The first connection area 112 comprises a receptacle 113, which forms the female part of a plug connection 130. Furthermore, the first connection area 112 comprises two opening arms 114, which are arranged on the side next to the receptacle 113 and via which a manual opening of the plug connection 130 is embodied. The first belt fastening area 116 comprises a first eyelet 117, via which the first belt end can be fastened by means of a permanent fastening mechanism. For example, the belt end can be pushed through the first eyelet 117 and be stitched and/or bonded, so that a permanent fastening is achieved as a result.

The second connector element 120 has a second connection area 122 and a second belt fastening area 126. The second connection area 122 has a central web 123, from which two lateral closing arms 124 project. The second connection area 122 forms the male part of the plug connection 130 by means of this structure. The closing arms 124 are configured in this case such that they project from the web 123 laterally after inserting the second connection area 122 into the receptacle 113 of the first connection area 112 such that a removal of the second connection area 122 from the first connection area 112 is blocked by the closing arms 124 and by a corresponding blocking area (not shown) of the first connection area 112. The second belt fastening area 126 has a second eyelet 127, via which the second belt end can be fastened via a permanent fastening mechanism. For example, the belt end can be pushed through the second eyelet 127 and be stitched and/or bonded, so that a permanent fastening is achieved as a result.

Due to the explained structures of the first connection area 112 and of the second connection area 122, these two connection areas form the plug connection 130, via which the two connection areas can be connected to one another in a detachable and positive-locking manner.

According to the present invention, the first belt fastening area 116 is configured such that a predetermined breaking point/region 140 is present in the area of the first eyelet 117. This predetermined breaking point/region 140 is embodied by a structural tapered area, which forms an area of lesser material thickness. In the exemplary embodiment being shown, the material in the area of the predetermined breaking point/region 140 has a minimal width B1 of at most 5 mm, especially at most 3 mm, preferably at most 1.5 mm. Outside of the predetermined breaking point/region, the material has a width B2 of more than 3 mm, especially more than 4 mm. The precise variant of the predetermined breaking point/region is selected according to the present invention such that an irreversible break takes place at the first belt fastening area 116 having the predetermined breaking point/region 140 when a predefined limit pulling force 150 is applied at the detachable belt connector system 100. The predefined limit pulling force 150 is preferably between 150 N and 250 N.

The second belt fastening area 126 of the second connector element 120 has a markedly greater material thickness in the area of the second eyelet 127 than the first belt fastening area 116 has in the area of the first eyelet 117. The material thickness in the area of the second eyelet 127 is at least 4 mm, especially at least 5 mm, especially preferably at least 6 mm. As a result, it is ensured in the exemplary embodiment shown that a separation of the two belt ends can be forced due to the action of a pulling force only over the predetermined breaking point/region 140.

The limit pulling force 150 acts in a direction located opposite a direction of motion for closing the plug connection 130.

In the exemplary embodiment shown, the two connector elements have a one-piece configuration each. Furthermore, they are manufactured by an injection molding process. The detachable belt connector system is manufactured from a plastic in the present case. Manufacturing from a plastic is especially preferred for the belt connector system according to the present invention because of the low manufacturing costs made possible thereby.

The structure of the two connection areas 112, 122 is selected to be such that in the connected state, the plug connection 130 is not detached when the predefined limit pulling force 150 is applied. It is ensured as a result that the detachable belt connector system 100 reliably remains closed as long as it is not opened by a manual actuation of the plug connection 130 or the predefined limit pulling force 150 is applied and leads to the break of the predetermined breaking point/region 140.

In one exemplary embodiment, not shown, at least one predetermined breaking point/region is provided at the first belt fastening area of the first connector element and at least one predetermined breaking point/region is provided at the second belt fastening area of the second connector element. A plurality of predetermined breaking points or breaking regions may be present at a single belt fastening area (cf. FIG. 6).

Figure 2:
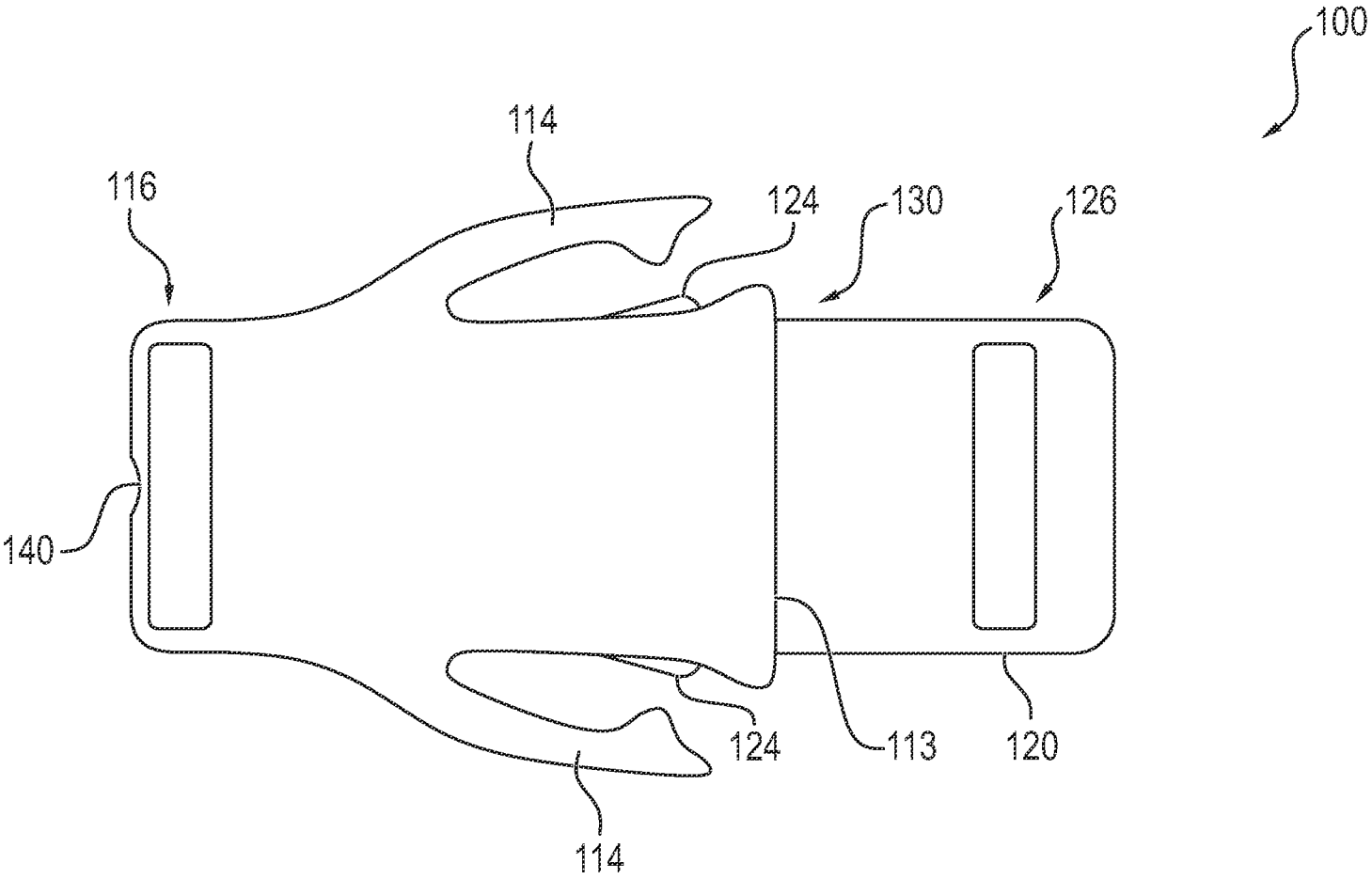
FIG. 2 is a schematic view of the first exemplary embodiment of the detachable belt connector system according to the present invention in a closed state.

FIG. 2 shows a schematic view of the first exemplary embodiment of the detachable belt connector system 100 according to the present invention in a closed state.

In the closed state shown, the closing arms 124 protrude laterally from the receptacle 113 such that a pulling of the second connector element 120 out of the receptacle 113 is prevented by means of a corresponding blocking area (not shown) in the area of the receptacle.

By means of a manual actuation of the two opening arms 114 by lateral pressure, the closing arms 124 can be pressed against the web and consequently make possible a detachment of the plug connection 130.

According to the present invention, two belt ends connected to the two belt fastening areas 116, 126 can only be separated from one another from the connected state of the plug connection 130 shown by the plug connection being detached manually or by an irreversible break of the predetermined breaking point/region taking place via the predefined limit pulling force.

Figure 5:
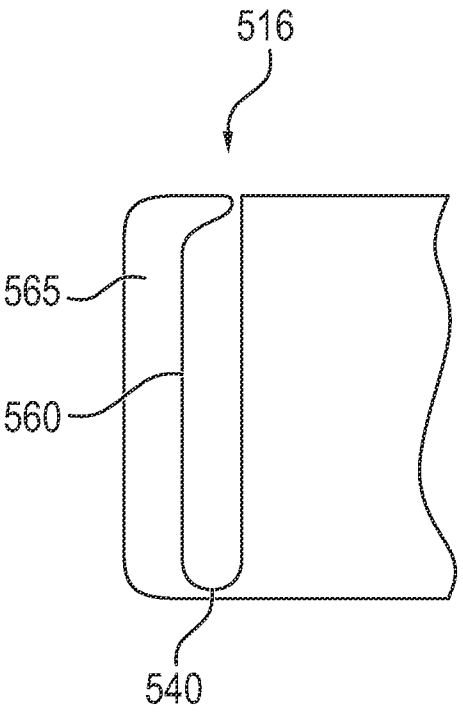
FIG. 5 is a schematic view of a particular belt fastening area with predetermined breaking point/region of a particular exemplary embodiment of the detachable belt connector system according to the present invention, wherein the belt fastening area has the predetermined breaking point/region that is formed at a hook of the belt fastening area.
Figure 4:
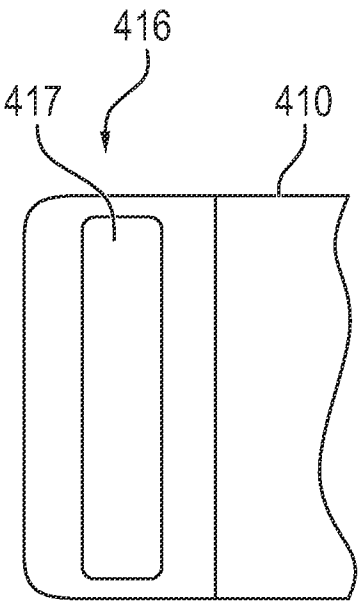
FIG. 4 is a schematic view of a particular belt fastening area with predetermined breaking point/region of a particular exemplary embodiment of the detachable belt connector system according to the present invention, wherein the belt fastening area has the predetermined breaking point/region that is manufactured from a different material than the rest of the connector element.
Figure 3:
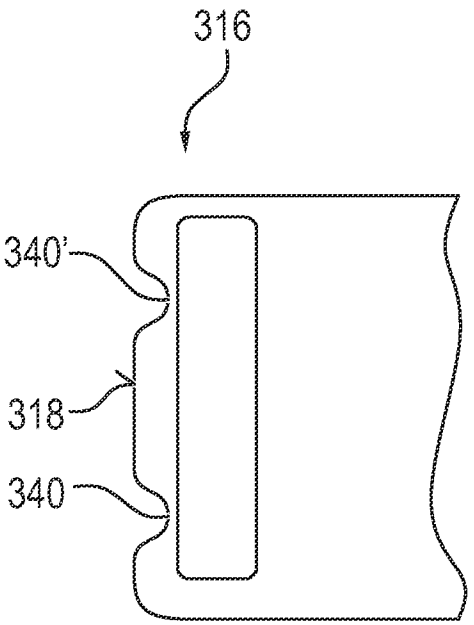
FIG. 3 is a schematic view of a particular belt fastening area with predetermined breaking point/region of a particular exemplary embodiment of the detachable belt connector system according to the present invention, wherein the belt fastening area has two predetermined breaking points/regions.

FIGS. 3, 4 and 5 show schematic views of a particular belt fastening area with a predetermined breaking point/region of a particular exemplary embodiment of the detachable belt connector system according to the present invention, wherein the belt fastening area 316 has two predetermined breaking points or breaking regions 340, 340' (FIG. 3), the predetermined breaking point/region is manufactured from a different material than the rest of the connector element 410 (FIG. 4), and the predetermined breaking point/region 540 is formed at a hook 560 of the belt fastening area 516 (FIG. 5).

The provision of at least two predetermined breaking points/regions 340, 340', as it is shown in FIG. 3, makes possible the breaking of the belt fastening area 316 at at least one of these predetermined breaking points 340, 340' in an especially reliable manner. The two predetermined breaking points 340, 340' are arranged on an outer surface 318 of the belt fastening area 316 in the exemplary embodiment shown.

The belt fastening area 416 shown in FIG. 4 is formed from a different material than the rest of the connector element 410. As a result, the first eyelet 417 is entirely formed from this different material. According to the present invention, the different material is selected such that it breaks at the predefined limit pulling force and/or that the connection in substance between the different material and the material from which the rest of the connector element 410 is formed breaks at the predefined limit pulling force.

The first belt fastening area 516 shown in FIG. 5 has a hook 560 for fastening a belt end. The predetermined breaking point 540 is arranged in this case at the area of the hook 560, which area connects the front web 565 of the hook 560 to the rest of the belt fastening area 516. In one exemplary embodiment, not shown, the predetermined breaking point is arranged within the belt fastening area in a different area of a hook.

Figure 6:
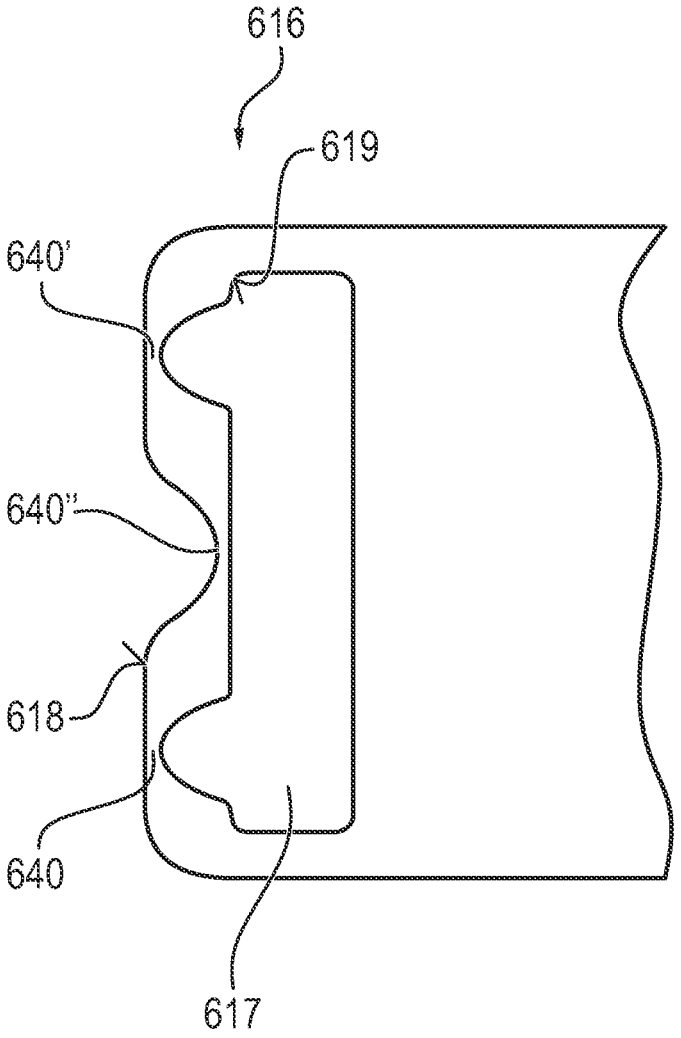
FIG. 6 is a schematic view of a belt fastening area with three predetermined breaking point/regions of an exemplary embodiment of the detachable belt connector system according to the present invention.

FIG. 6 shows a schematic view of a belt fastening area 616 with three predetermined breaking points 640, 640', 640" of an especially preferred exemplary embodiment of the detachable belt connector system according to the present invention.

In the exemplary embodiment being shown, two of the predetermined breaking points 640, 640' are arranged on an inner surface 619 of the first eyelet 617 and another predetermined breaking point 640" is arranged on an outer surface 618 of the first eyelet 617. The other predetermined breaking point 640" is located spatially between the two other predetermined breaking points 640, 640'. For the shown structure of the predetermined breaking points 640, 640', 640" it can be determined in an especially reliable manner, especially determined via known methods of structural analysis, how a particular material thickness has to be selected so that an irreversible break takes place at at least one of these predetermined breaking points 640, 640', 640" when the predefined limit pulling force is applied.

The predetermined breaking points 640, 640', 640" are in the exemplary embodiment being shown formed via semicircular tapered areas of the material enclosing the eyelet 617. In one exemplary embodiment, not shown, at least one tapered area for providing the predetermined breaking point/region has an angular, especially rectangular or triangular configuration.

Other arrangements of a plurality of predetermined breaking points or breaking regions are possible according to the present invention to achieve that an irreversible break occurs at at least one of these predetermined breaking points or breaking regions when the predefined limit pulling force is applied.

The provision of the predetermined breaking point/region at the first connector element is only an example within the framework of the exemplary embodiments shown. In one exemplary embodiment, not shown, the predetermined breaking point/region is formed at the second connector element.

The provision of a plug connection is only an example in the exemplary embodiments shown. In one exemplary embodiment, not shown, the connection between the two connector elements is a detachable clamped connection.

Figure 7:
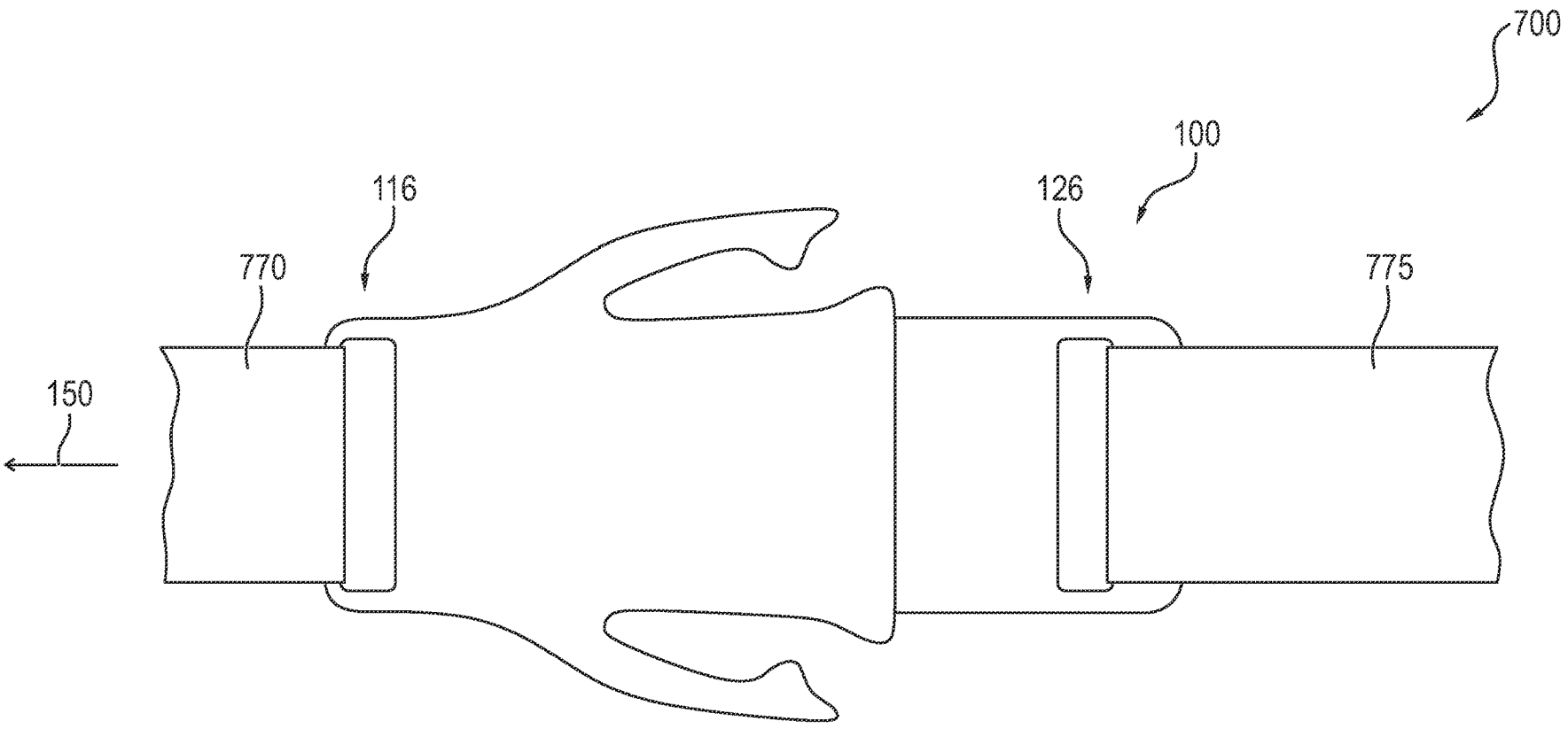
FIG. 7 is a schematic view of an exemplary embodiment of a chin strap lock according to another aspect of the present invention.

FIG. 7 shows a schematic view of a chin strap lock 700 according to another aspect of the present invention.

The chin strap lock 700 comprises the detachable belt connector system 100 that is shown in FIG. 1 and FIG. 2. The predetermined breaking point/region according to the present invention is covered by the first belt end 770, which is arranged at the first belt fastening area 116.

Furthermore, the chin strap lock 700 comprises the second belt end 775, which is arranged at the second belt fastening area 126. The belt ends are here each permanently fastened at the particular belt fastening area 116, 126 by a stitching of the particular belt end to itself.

The predefined limit pulling force is typically a force that pulls the two belt ends 770, 775 away from one another and thereby exerts a force on the predetermined breaking point/region of the detachable belt connector system 100.

Figure 8:
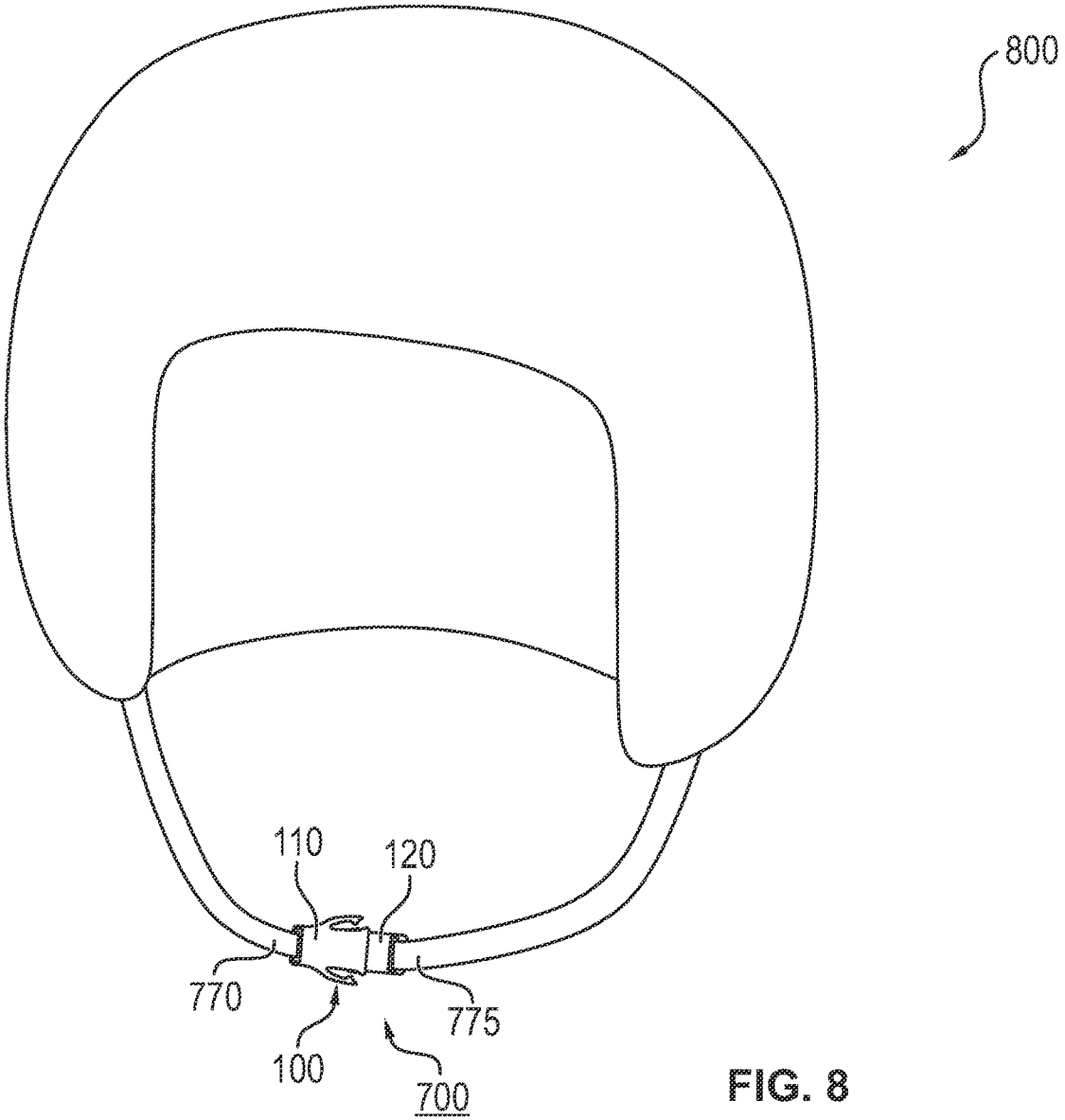
FIG. 8 is a schematic view of an exemplary embodiment of a safety helmet according to an especially advantageous aspect of the present invention.

FIG. 8 shows a schematic view of the safety helmet 800 according to an especially advantageous aspect of the present invention.

The safety helmet 800 comprises helmet body and the chin strap lock 700 shown in FIG. 7 and therefore also the detachable belt connector system 100 shown in FIG. 1 and FIG. 2.

According to the present invention, the safety helmet may be, for example, a firefighter helmet, a motorcycle helmet, a bicycle helmet or the like. The safety helmet 800 is especially preferably a firefighter helmet.

According to the present invention, an extreme stress on the safety helmet 800 may lead to a force acting between the two belt ends 770, 775. This force may lead, for example, to a strangulation of the user of the safety helmet, so that according to the present invention the predetermined breaking point/region of the detachable belt connector system 100 breaks when the predefined limit pulling force is reached and as a result releases the two belt ends. As a result, a continuous strangulation of the user of the safety helmet 800 is prevented according to the present invention.

Especially advantageously, the plug connection 130 in this case is configured to connect the two connector elements 110, 120 of the detachable belt connector system 100 to one another in a reliable manner even when the predefined limit pulling force is applied. It is consequently ensured that the safety helmet 800 is fixed securely on the head of the user and fulfills its protective function for the user thereby. The detachable belt connector system 100 according to the present invention for the safety helmet 800 according to the present invention can consequently ensure that there is a reliable fixing of the safety helmet 800 on the head and that when an acting force occurs, especially when an acting force occurs suddenly, the risk of the strangulation of the user is prevented by the breaking of the predetermined breaking point/region when the predefined limit pulling force is present.

While specific embodiments of the invention have been shown and described in detail to illustrate the application of the principles of the invention, it will be understood that the invention may be embodied otherwise without departing from such principles.

LIST OF REFERENCE CHARACTERS

100 Detachable belt connector system
110, 410 First connector element
112 First connection area
113 Receptacle
114 Opening arm
116, 316, 416, 516, 616 First belt fastening area
117, 417, 617 First eyelet
120 Second connector element
122 Second connection area
123 Web
124 Closing arm
126 Second belt fastening area
127 Second eyelet
130 Plug connection
140, 340, 340', 540, 640, 640', 640" Predetermined breaking point/region
150 Predefined limit pulling force
318, 618 Outer surface
560 Hook
565 Front web of the hook
619 Inner surface
700 Chin strap lock
770 First belt end
775 Second belt end
800 Safety helmet
B1 Minimal width at the predetermined breaking point/region
B2 Width outside of the predetermined breaking point/region

What is claimed is:

1. A detachable belt connector system for a detachable connection of a first belt end and of a second belt end, the detachable belt connector system comprising:

a first connector element comprising a first connection area and a first belt fastening area; and a second connector element comprising a second connection area and a second belt fastening area, wherein:

the first connection area and the second connection area are configured such that the first connector element and the second connector element connect to one another detachably with a positive-lock via the two connection areas;

the first belt end is fastenable at the first belt fastening area via a first end permanent fastening mechanism associated with the first belt end and the second belt end is fastenable at the second belt fastening area via a second end permanent fastening mechanism associated with the second belt end; and the first belt fastening area and/or the second belt fastening area are configured with a predetermined breaking region, by means of which an irreversible break takes place at the belt fastening area having the predetermined breaking region when a predefined limit pulling force is applied at the detachable belt connector system.

2. A detachable belt connector system in accordance with claim 1, wherein in a state of being connected to one another the two connection areas are configured such that they are not detached from one another when the predefined limit pulling force is applied.

3. A detachable belt connector system in accordance with claim 1, wherein each of the first connector element and the second connector element have a one-piece configuration.

4. A detachable belt connector system in accordance with claim 1, wherein the predetermined breaking region is formed in a break ring, in an eyelet, in a hook, in a structural tapered area and/or in a bending beam of the corresponding belt fastening area.

5. A detachable belt connector system in accordance with claim 1, wherein an area of lesser material thickness is formed at the predetermined breaking region in comparison to a material thickness present at a spaced location from the predetermined breaking region.

6. A detachable belt connector system in accordance with claim 1, wherein the predetermined breaking region is manufactured from a different material than the corresponding connection area of the corresponding connector element.

7. A detachable belt connector system in accordance with claim 1, wherein the detachable belt connector system is manufactured by an injection molding process.

8. A detachable belt connector system in accordance with claim 1, wherein:

the two connector elements form a plug connection; and the first connection area forms a male part of the plug connection and the second connection area forms a female part of the plug connection.

9. A chin strap lock comprising:

a first strap with a first strap end;

a second strap with a second strap end;

a first connector element comprising a first connection area and a first strap fastening area; and a second connector element comprising a second connection area and a second strap fastening area, wherein:

the first connection area and the second connection area are configured such that the first connector element and the second connector element connect to one another detachably with a positive-lock via the two connection areas;

the first strap end is fastened at the first strap fastening area via a first end permanent fastening mechanism associated with the first strap end and the second strap end is fastened at the second strap fastening area via a second end permanent fastening mechanism associated with the second strap end; and the first strap fastening area and/or the second strap fastening area are configured with a predetermined breaking region, by means of which an irreversible break takes place at the strap fastening area having the predetermined breaking region when a predefined limit pulling force is applied at the detachable strap connector system.

10. A chin strap lock in accordance with claim 9, wherein the predefined limit pulling force is a pulling force applied between the two strap ends.

11. A chin strap lock in accordance with claim 9, wherein in a state of being connected to one another the two connection areas are configured such that they are not detached from one another when the predefined limit pulling force is applied.

12. A chin strap lock in accordance with claim 9, wherein each of the first connector element and the second connector element have a one-piece configuration.

13. A chin strap lock in accordance with claim 9, wherein the predetermined breaking region is formed in a break ring, in an eyelet, in a hook, in a structural tapered area and/or in a bending beam of the corresponding belt fastening area.

14. A chin strap lock in accordance with claim 9, wherein an area of lesser material thickness is formed at the predetermined breaking region in comparison to a material thickness present at a spaced location from the predetermined breaking region.

15. A chin strap lock in accordance with claim 9, wherein the predetermined breaking region is manufactured from a different material than the corresponding connection area of the corresponding connector element.

16. A safety helmet comprising:

a helmet body;

a chin strap lock connected to the helmet body, the chin strap lock comprising:

a first strap with a first strap end;

a second strap with a second strap end;

a first connector element comprising a first connection area and a first strap fastening area; and a second connector element comprising a second connection area and a second strap fastening area, wherein:

the first connection area and the second connection area are configured such that the first connector element and the second connector element connect to one another detachably with a positive-lock via the two connection areas;

the first strap end is fastened at the first strap fastening area via a first end permanent fastening mechanism associated with the first strap end and the second strap end is fastened at the second strap fastening area via a second end permanent fastening mechanism associated with the second strap end; and the first strap fastening area and/or the second strap fastening area are configured with a predetermined breaking region, by means of which an irreversible break takes place at the strap fastening area having the predetermined breaking region when a predefined limit pulling force is applied at the detachable strap connector system.

17. A safety helmet in accordance with claim 16, wherein:

the predefined limit pulling force is a pulling force applied between the two strap ends; and in a state of being connected to one another the two connection areas are configured such that they are not detached from one another when the predefined limit pulling force is applied.

18. A safety helmet in accordance with claim 16, wherein each of the first connector element and the second connector element have a one-piece configuration.

19. A safety helmet in accordance with claim 16, wherein the predetermined breaking region is formed in a break ring, in an eyelet, in a hook, in a structural tapered area and/or in a bending beam of the corresponding belt fastening area.

20. A safety helmet in accordance with claim 19, wherein the predetermined breaking region comprises at least one of:

an area of lesser material thickness in comparison to a material thickness present at adjacent regions of the corresponding belt fastening area; and a different material in comparison to a material present at adjacent regions of the corresponding belt fastening area.

* * * * *